US008112940B2

(12) United States Patent
Mayer

(10) Patent No.: US 8,112,940 B2
(45) Date of Patent: Feb. 14, 2012

(54) SEAL ARRANGEMENT ON A VERTICAL FRAME PROFILE OF A DOOR WING

(75) Inventor: Christian Mayer, Unterthuerhim (DE)

(73) Assignee: Dorma GmbH + Co. KG, Ennepetal (DE)

( * ) Notice: Subject to any disclaimer, the term of this patent is extended or adjusted under 35 U.S.C. 154(b) by 534 days.

(21) Appl. No.: 11/658,429

(22) PCT Filed: Jul. 13, 2005

(86) PCT No.: PCT/EP2005/007590
§ 371 (c)(1),
(2), (4) Date: Jan. 26, 2007

(87) PCT Pub. No.: WO2006/010477
PCT Pub. Date: Feb. 2, 2006

(65) Prior Publication Data

US 2009/0211166 A1 Aug. 27, 2009

(30) Foreign Application Priority Data

Jul. 27, 2004 (DE) ..... 10 2004 036 309

(51) Int. Cl.
*E06B 7/16* (2006.01)

(52) U.S. Cl. ..... 49/489.1; 49/498.1; 160/199; 160/40

(58) Field of Classification Search ..... 49/475.1, 49/489.1, 498.1, 27; 160/40, 43, 199, 213; 200/61.43
See application file for complete search history.

(56) References Cited

U.S. PATENT DOCUMENTS

| | | | | | |
|---|---|---|---|---|---|
| 1,998,791 | A | * | 4/1935 | Schanz | 49/489.1 |
| 2,263,806 | A | * | 11/1941 | Hammerl | 49/498.1 |
| 2,611,937 | A | | 3/1950 | Kendrick | |
| 3,118,984 | A | * | 1/1964 | Koenig | 200/61.43 |
| 3,140,517 | A | * | 7/1964 | Richter | 49/489.1 |
| 3,883,993 | A | * | 5/1975 | Pullan | 49/490.1 |
| 3,952,455 | A | * | 4/1976 | McAlarney | 49/496.1 |
| 4,115,952 | A | * | 9/1978 | French | 49/26 |
| 4,719,412 | A | | 1/1988 | D'Humieres et al. | |
| 4,807,397 | A | * | 2/1989 | Doan | 49/498.1 |
| 5,092,089 | A | * | 3/1992 | Kessler | 52/200 |

(Continued)

FOREIGN PATENT DOCUMENTS

| | | |
|---|---|---|
| CH | 399 925 | 9/1965 |
| DE | 15 09 167 | 12/1968 |
| DE | 79 01 833 | 1/1979 |
| DE | 35 38 862 | 5/1987 |

(Continued)

OTHER PUBLICATIONS

Search Report dated Oct. 19, 2005 for the underlying International Application No. PCT/EP2005/007590.

*Primary Examiner* — Gregory J. Strimbu
(74) *Attorney, Agent, or Firm* — Cozen O'Connor

(57) ABSTRACT

A seal, which is disposed at a vertical frame profile of a stationary door leaf or of a movable door leaf and has a sealing profile protruding from the frame profile and a deformation chamber extending in a longitudinal direction of the sealing profile. A part of the sealing profile protruding from the front side of the frame profile in cross-section forms the portion (T) of an ellipse or substantially of an ellipse, the minor axis (N) of the ellipse intersecting the wall of the sealing profile outside the frame profile.

11 Claims, 3 Drawing Sheets

U.S. PATENT DOCUMENTS

| | | | | | |
|---|---|---|---|---|---|
| 5,581,951 | A * | 12/1996 | Ryan et al. | 49/498.1 |
| 5,887,392 | A * | 3/1999 | Martin | 52/204.5 |
| 6,158,171 | A * | 12/2000 | Kellogg et al. | 49/489.1 |
| 6,740,826 | B1 * | 5/2004 | Friedrich et al. | 200/61.43 |
| 6,832,451 | B2 * | 12/2004 | Yamashita et al. | 49/498.1 |
| 6,851,222 | B2 * | 2/2005 | Albiero | 49/27 |

FOREIGN PATENT DOCUMENTS

| | | | |
|---|---|---|---|
| DE | 197 22 818 | | 12/1997 |
| DE | 298 08 292 | U1 | 9/1998 |
| DE | 198 05 610 | | 8/1999 |
| EP | 1 087 091 | B1 | 12/2006 |
| WO | WO 01/44611 | A2 * | 6/2001 |

* cited by examiner

SEAL ARRANGEMENT ON A VERTICAL FRAME PROFILE OF A DOOR WING

CROSS-REFERENCE TO RELATED APPLICATIONS

This is a U.S. national stage of International Application No. PCT/EP2005/007590, filed on 13 Jul. 2005. Priority is claimed on German Application No. 10 2004 036 309.9, filed on 27 Jul. 2004.

BACKGROUND OF THE INVENTION

1. Field of the Invention

The invention relates to a seal, which is disposed at a vertical frame profile of a stationary door leaf or of a movable door leaf and has an elastic sealing profile protruding from the front side of the frame profile, which sealing profile has a web abutting the frame profile and being connected to the frame profile, and a deformation chamber extending in longitudinal direction of the sealing profile and being delimited by the web.

2. Description of the Related Art

Seals of the species mentioned above are used for example when designing smoke-tight doors which guarantee sterile work spaces and generally avoid draught air. In this case, glass leaf doors are used increasingly, the glass panes thereof being clamped in a frame profile. In this case, the seal between two movable leaves or between a stationary leaf and a movable leaf must be formed such that it develops its optimum sealing effect at a given minimum distance, i.e. a given gap between two adjacent leaves in their closing position. This effect needs to be guaranteed even with front sides, which are not absolutely aligned one in front of the other, i.e. horizontally offset in lateral direction, or with adjacent leaves' front sides, which are restrictedly angled towards each other.

U.S. Pat. No. 2,611,937 discloses a sealing device of this species generally designed for rail-bound vehicles. In this case, an elastic sealing element, having sealing lips and being approximately O-shaped in cross-section, is disposed at the front side of a movable door leaf, and a rigid flange-shaped sealing element engaging between the sealing lips is disposed at the front side of the stationary door leaf, intended to thereby achieve a triple sealing with the door being closed. This is a structural complicated double sealing, consisting of an elastic and a firm sealing part. The individual sealing elements are connected through screw connections to the door leaf by means of fittings, which in a U-shape, overlap the front side of the door leaf, i.e. they are not suitable to be used for the sealing of glass doors. Moreover, the proper functioning is only guaranteed with an aligned disposition of the door leaves.

SUMMARY OF THE INVENTION

It is an object of the invention to improve a seal species in that reliable sealing properties are guaranteed with a simple structural embodiment, even with front sides of adjacent door leaves, which are restrictedly offset in a horizontal plane towards each other or with door leaves, which are restrictedly angled towards each other. The seal is intended to be universally applicable for door leaves, as long as they are provided with a frame profile, i.e. especially with stationary or movable glass leaves, on condition that, in the closed position, a generally defined gap is given between the leaves that are to be sealed in relation to each other.

The invention solves the given problem with a seal disposed in a vertical frame profile of one of a stationary door leaf, a movable door leaf, or a stationary wall, said seal comprising an elastic sealing profile extending longitudinally along a longitudinal axis of the frame profile and protruding from a front side of the frame profile, the sealing profile being defined by a first web abutting and being connected to the frame profile and a wall which merges into said web and encloses a longitudinal hollow space, said wall having a cross-sectional shape forming a portion of an ellipse arranged so that a minor axis of the ellipse intersects the wall in an area that is outside of the frame profile and in the hollow space, said sealing profile further including a deformation chamber extending longitudinally through the sealing profile and delimited toward the frame profile by said first web, and at least two second webs arranged on either side of the major axis of the ellipse supporting the wall, said at least two second webs intersecting approximately at a center of the ellipse.

By means of an elliptically or generally elliptically embodied portion of the walling of a sealing profile, which portion protrudes from the front side of a frame profile, in conjunction with the feature that the minor axis of the ellipse intersects the walling of the sealing profile outside the frame profile, that means intersects it in the area of the gap between adjacent leaves in the closed position, reliable sealing properties are provided even in the case of door leaves being restrictedly angled towards each other. This results from the fact that—a gap normally used in the practice and generally defined between the adjacent door leaves being a prerequisite—an ellipse wall with a falling curve on the one side is compensated for by an ellipse wall with a rising curve on the other side. Webs reinforcing the hollow space prevent the wall of the sealing profile from yielding too much and simultaneously stabilize the sealing profile during the insertion process into the adjacent door leaf.

Further preferred embodiments of the invention will become apparent from the following discussion.

The webs, supporting the wall of the sealing profile, on either side of the major axis of the ellipse, abut a wall of the deformation chamber at the other end such that forces acting upon the of the sealing profile can be introduced into the deformation chamber via the webs and can be absorbed therein.

In a further embodiment of the invention, devices for a connection to the frame profile, which devices preferably consist of strip-like projections, are disposed at the web abutting the frame profile, and which, as an integral part of the web, rearward engage complementary projections of the frame profile in a hook-like manner. The above embodiment of the sealing profile's connection to the frame profile guarantees, on the one side, a tension and compression resistant connection between the sealing profile and the frame profile and, on the other side, allows for an easy exchange of the seal in the event of wearing, because any screw connections are eliminated.

BRIEF DESCRIPTION OF THE DRAWINGS

In the following, the invention will be explained in more detail, reference being made to an exemplary embodiment, in which.

DETAILED DESCRIPTION OF THE PRESENTLY PREFERRED EMBODIMENTS

Figure 1:
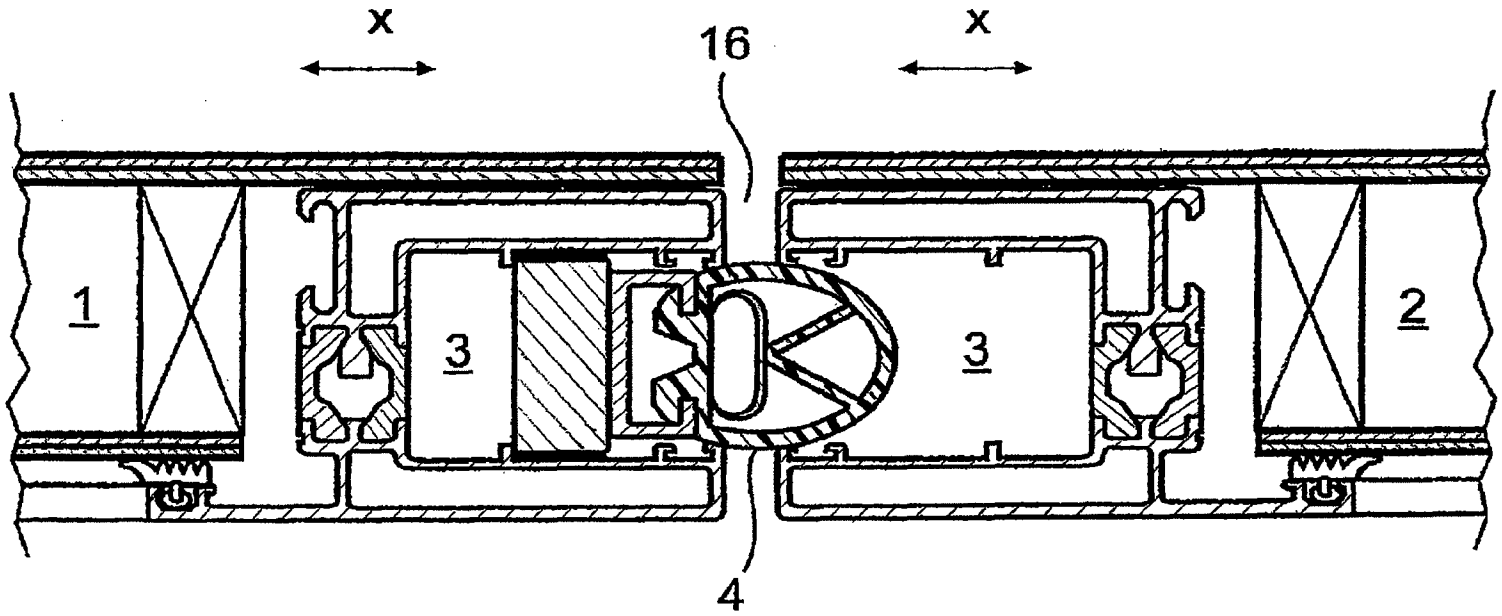
FIG. 1 shows a horizontal section through a partitioning wall consisting of glass leaf panels.

In the illustrated exemplary embodiment, a first door leaf is referenced by 1 and a second door leaf by 2. The door leaves 1 and 2 are displaceable in direction X. Both door leaves have vertical frame profiles 3, which, in the closed position, are located in front of each other while forming a gap 16. In the exemplary embodiment, a seal 4 is connected to the first leaf 1; as the frame profiles 3 are mirror-inverted, the seal 4, as an option, can be disposed at the second door leaf 3 as well or at any other of the leaves or at a stationary partitioning wall.

Figure 2:
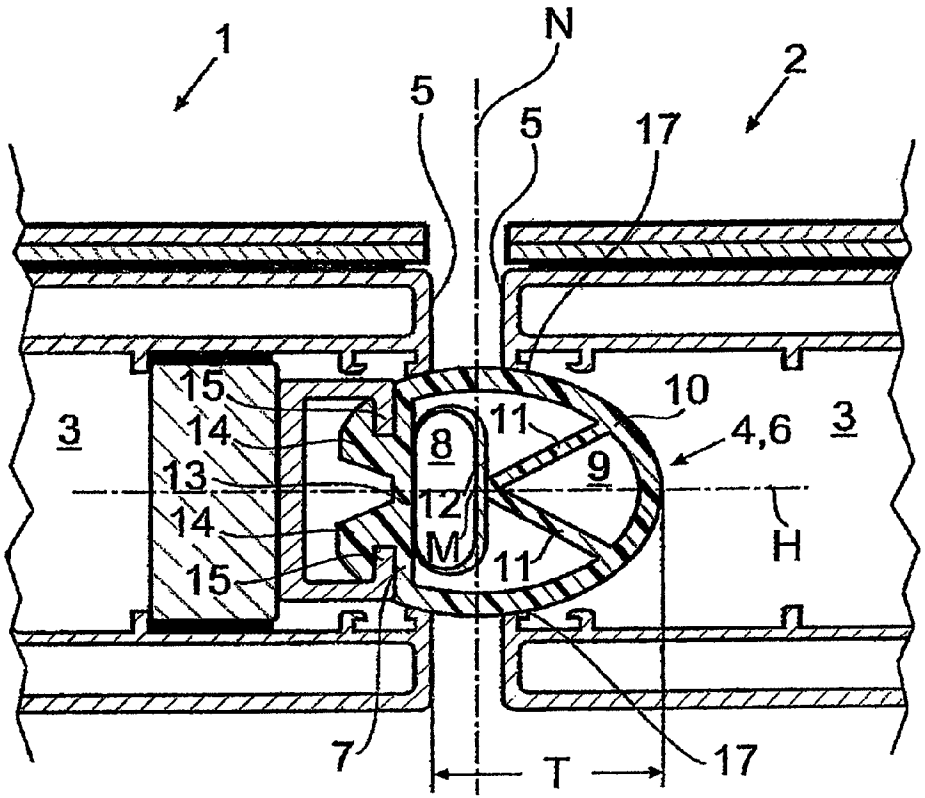
FIG. 2 shows, compared to FIG. 1, an enlarged illustration of the seal between two adjacent leaves or between a leaf and a stationary wall.

As FIG. 2 reveals, the seal 4 with a proper sealing profile 6 protrudes from a front side 5 of the frame profile 3 by a portion of the sealing profile 6 identified by T. A wall 10 of the sealing profile 6 follows the shape of a portion of an ellipse and, according to FIG. 2, in the area of a connection to the stationary door leaf 1, merges into a web 7, which, with integrally conformed projections 14, rearward engages complementary projections 15 of the frame profile 3. Furthermore, a deformation chamber 8 is provided extending in longitudinal direction of the seal 4. Two webs 11, extending on either side of the major axis H of a wall 10 of the sealing profile 6 into the direction of the deformation chamber 8, reinforce a hollow space, identified by 9, of the sealing profile 6. The webs 11 are connected to a wall 12 of the deformation chamber 8 such that they intersect each other almost in the centre M of the ellipse, i.e. in the intersection point of the major axis H and the minor axis N. The wall opposite the wall 12 of the deformation chamber 8 is formed by a portion 13 of the web 7.

Figure 3:
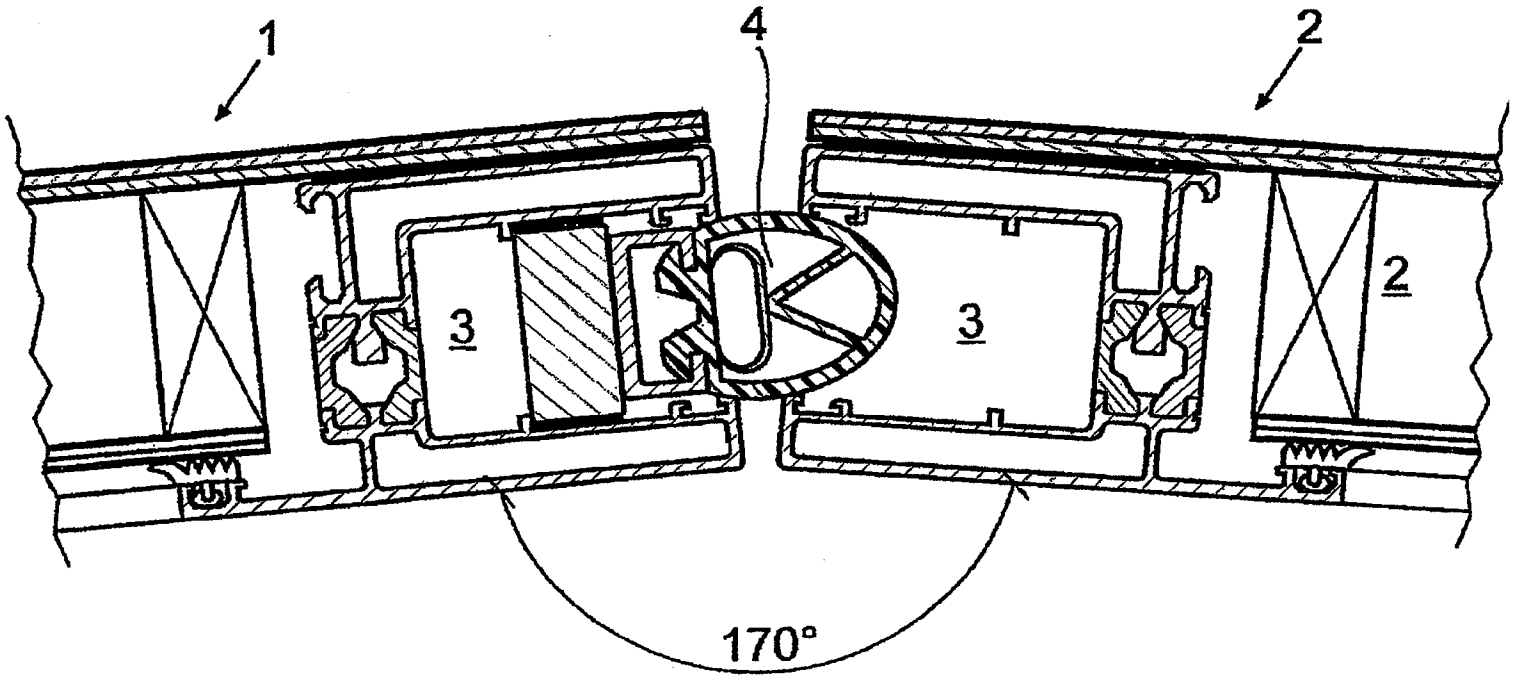
FIG. 3 shows a detail according to FIG. 1 with leaves restrictedly angled towards each other.

FIG. 2 clearly shows that the elliptical or generally elliptical shape of the sealing profile 6 is designed such that the minor axis N extends in the area of the gap 16 between the adjacent door leaves 1 and 2. This means that the movable door leaf 2, in FIG. 2 on the right side of the illustration, during a pivoting movement in relation to the stationary door leaf 1 (cf. FIG. 3), moves with the sealing edges 17 of the frame profile 3 along the curve path of the wall 10 of the sealing profile 6, such that the upper sealing edge 17 in the plane of the illustration follows a falling curve path and the lower sealing edge 17 in the plane of the illustration follows a rising curve path, resulting in sealing properties which are guaranteed even with leaves restrictedly angled towards each other. In FIG. 3 the exemplary angle is indicated with 170°.

What is claimed is:

1. A seal disposed in a vertical frame profile of one of a stationary door leaf, a movable door leaf, and a stationary wall, said seal comprising an elastic sealing profile extending longitudinally along a longitudinal axis of the frame profile and protruding from a front side of the frame profile, the sealing profile comprising:

a first web abutting and connected to the frame profile;

a first wall which merges into said first web and said first wall together with said first web enclose a longitudinal hollow space, said first wall having a cross-sectional shape forming a portion of an ellipse and is arranged so that a minor axis of the ellipse intersects the first wall in an area that is outside of the frame profile;

a deformation chamber defined at least partially by a walling and extending longitudinally through the sealing profile in the longitudinal hollow space, a side of the deformation chamber facing the frame profile being delimited by said first web; and at least two second webs each arranged on a respective side of a major axis of the ellipse and supporting the first wall, said at least two second webs intersecting each other approximately at a center of the ellipse and abut the walling of said deformation chamber so as to transmit forces acting upon said first wall to said deformation chamber via said at least two second webs;

wherein the entire cross-sectional shape of said first wall forms the portion of the ellipse.

2. The seal of claim 1, wherein the deformation chamber is delimited only by the first web and said walling.

3. The seal of claim 1, wherein said first web includes profiles complementary to the frame profile and arranged to connect the seal to the frame profile.

4. The seal of claim 3, wherein said complementary profiles include strip-shaped projections which interlock and engage projections on the frame profile.

5. The seal of claim 4, wherein said strip-shaped projections comprise hook-shaped projections which engage rear-facing surfaces of said projections on the frame profile.

6. The seal of claim 1, wherein at least a portion of the walling of the deformation chamber extends approximately in parallel the minor axis of the ellipse.

7. The seal of claim 1, wherein said at least two second webs are positioned outside said deformation chamber.

8. The seal of claim 7, wherein said at least two second webs abut a center of the walling of said deformation chamber.

9. A door panel comprising:

a first vertical frame profile having a front side; and a seal configured to be mounted in the first vertical frame profile and comprising an elastic sealing profile, said sealing profile extending longitudinally along a longitudinal axis of the first vertical frame profile and protruding from the front side of the first vertical frame profile, said sealing profile comprising:

a first web configured to abut and be connected to the frame profile;

a first wall which merges into said first web and said first wall together with said first web enclose a longitudinal hollow space, said first wall having a cross-sectional shape forming a portion of an ellipse and is arranged so that a minor axis of the ellipse intersects the first wall in an area that is outside of the frame profile;

a walling at least partially enclosing a deformation chamber extending longitudinally through the sealing profile in the longitudinal hollow space, a side of the deformation chamber facing the frame profile being delimited by said first web; and at least two second webs each arranged on a respective side of a major axis of the ellipse and supporting the first wall, said at least two second webs intersecting each other approximately at a center of the ellipse and abut the walling of said deformation chamber so as to transmit forces acting upon said first wall to said deformation chamber via said at least two second webs;

wherein the entire cross-sectional shape of said first wall forms the portion of the ellipse.

10. The door panel of claim 9, further comprising a second vertical frame profile extending along the longitudinal axis of the first vertical frame profile and configured to receive at least part of said sealing profile.

11. A door assembly comprising a plurality of door panels each as claimed in claim 9.

* * * * *